US006889026B2

(12) United States Patent
Schlageter et al.

(10) Patent No.: US 6,889,026 B2
(45) Date of Patent: May 3, 2005

(54) METHOD OF CONVEYING TONER FROM A TONER REFILL CONTAINER

(75) Inventors: Bernhard Schlageter, Unterhaching (DE); Reinhold Schmidl, Fuerstenfeldbruck (DE); René Froeschl, Brunnthal (DE); Christian Heil, Dorfen (DE); Josef Ranner, Ebersberg (DE); Ursula Schafer, Penzberg (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/446,271

(22) Filed: May 23, 2003

(65) Prior Publication Data

US 2004/0037591 A1 Feb. 26, 2004

(30) Foreign Application Priority Data

May 24, 2002 (DE) ..... 102 23 232

(51) Int. Cl.[7] ..... G03G 15/08
(52) U.S. Cl. ..... 399/258; 399/119
(58) Field of Search ..... 399/258, 260, 399/262, 119, 120

(56) References Cited

U.S. PATENT DOCUMENTS 3,958,878 A * 5/1976 Smith et al. ..... 399/359
4,990,964 A 2/1991 Kraehn
5,074,342 A 12/1991 Kraehn
5,075,724 A * 12/1991 Wada et al. ..... 399/12
5,175,587 A * 12/1992 Kato et al. ..... 399/262
5,727,607 A 3/1998 Ichikawa et al.
5,915,154 A 6/1999 Schoch et al.

FOREIGN PATENT DOCUMENTS

DE 30 11 838 10/1980
DE 44 00 708 A1 7/1994
EP 0 238 939 9/1987
JP 06250450 A * 9/1994 ..... G03G/15/00

* cited by examiner

*Primary Examiner*—Quana Grainger
(74) *Attorney, Agent, or Firm*—Schiff Hardin LLP

(57) ABSTRACT

A method of conveying toner material from a refill container is provided, wherein a refill container having an opening for the discharge of toner material is arranged in a receptacle device in a first substantially upright position. In this first position, the opening is closed by a closing device. The refill container is swiveled into the second position with bottom opening with the aid of the receptacle device. Toner material is taken from the refill container via a discharge opening provided in the closing device. Further, the invention relates to a device for conveying toner material and to an associated toner refill container.

16 Claims, 9 Drawing Sheets

METHOD OF CONVEYING TONER FROM A TONER REFILL CONTAINER

BACKGROUND OF THE INVENTION

1. Field of the Invention

The present invention relates to a method of conveying toner material from a toner refill container in an electrographic printer or copier. A toner refill container is inserted into an electrographic printer or copier and emptied via an opening. Further, the invention relates to a device for inserting a toner refill container into an electrographic printer or copier as well as to an associated toner refill container.

2. Description of the Related Art

In electrophotographic printers or copiers, a latent charge image is generated on a light-sensitive photoconductor material, a photoconductor drum or a photoconductor belt. Subsequently, this charge image is inked with electrically charged toner in a developer station of the printer or copier. The inked toner image is then transferred onto a carrier material, e.g. paper, and fixed thereon.

A one-component developer or a two-component developer is used for developing the latent charge image in the developer station. The one-component developer only contains toner particles; the two-component developer contains a mixture of toner particles and carrier particles. With a two-component developer, the toner particles are electrically charged by moving the two-component developer mixture. For the one-component developer, the charging of the toner particles takes place via charge transport, for example, from a carrier drum.

The amount of toner required for generating the toner image has to be supplied to the developer station so that further toner images can be generated. In known printers or copiers, an intermediate toner reservoir in which toner material is intermediately stored is provided near the developer station, toner material being conveyed from this reservoir into the developer station depending on need or, respectively, on consumption.

In known printers or copiers, the toner material is filled from handy refill containers via an opening directly into the reservoir or from a remotely arranged refill container through a transport system into the reservoir. In known printers or copiers, the reservoir arranged near the developer station has a level sensor. In the case of a minimum filling level, toner material has to be supplied to the reservoir from the refill container. This is, for example, effected by emptying a refill container into the reservoir. In other known arrangements, closed containers in the form of bottles or cartridges that are filled with toner material are adapted to an opening in the reservoir. The bottle or cartridge is opened by pulling a slide and/or breaking a tab, as a result whereof the toner material can drop into the reservoir.

However, these solutions for refilling toner material into the reservoir involve a high risk of contamination for an operator and the surrounding of the reservoir when filling in the toner material and when removing the emptied refill container. A low weight and a small structural size of the bottles and/or the cartridges indeed allows a simple and safe handling during refilling of the reservoir, however, in the case of a high toner consumption frequent refilling of the reservoir is required, as a result whereof extended machine downtimes occur and the operator is highly stressed.

U.S. Pat. No. 4,990,964 and U.S. Pat. No. 5,074,342 disclose a toner refill container and a device for the non-contaminating change of such a refill container in a toner conveying means of a printer or copier. When needed, toner material is transported from a toner refill container arranged remotely from the developer station into the reservoir via a hose by means of suction air. A vertically displaceable suction nozzle immerses via an opening arranged in the top of the toner container and sucks out toner material. A special shape of the toner container and a laterally mounted shaking means provide an almost complete emptying of the container. For changing the toner refill container, the suction nozzle is extracted from the container. The opening is always arranged on the top of the toner container, as a result whereof spilling of toner is avoided. However, the conveying capacity is heavily dependent on the filling level in the toner container. When the filling level decreases, the conveying capacity of toner material likewise decreases so that the printing operation is interrupted in the case of a low toner filling level in the toner refill container and a simultaneous high toner demand in the developer station. Further, the shaker means creates disturbing sounds.

U.S. Pat. No. 5,915,154 discloses an apparatus for conveying toner material from a toner refill container by means of a suction/pressure unit that projects into the refill container. Toner material is mixed with gas with the aid of the suction/pressure unit so that the toner material to be sucked in is mixed to a powder/gas mixture, as a result whereof the removal of the finely powdered toner material out of the refill container is facilitated. However, this known apparatus, too, has the problem that when the filling level in the refill container decreases, the conveying capacity likewise decreases, this resulting in the already described interruption of the printing process as a consequence of too little re-supply of toner material.

SUMMARY OF THE INVENTION

The invention provides a method and a device for conveying toner material from a toner refill container as well as an associated toner refill container, in which method or, respectively, device a simple handling of the toner refill container is guaranteed as well as downtimes of the printer or copier are avoided.

The method of conveying toner material from a toner refill container in an electrophotographic printer or copier provides that a refill container having an opening for the discharge of toner material is arranged in a receptacle device in a substantially upright first position, the opening is closed in this first position by a closing device, the refill container is swiveled into a second position with a bottom opening with the aid of the receptacle device, and wherein toner material is taken from the refill container via a discharge opening provided in the closing device.

The device for conveying toner material from a refill container provides that a receptacle device for a refill container is provided, the refill container having an opening for the discharge of toner material and being insertable into the receptacle device in a first substantially vertical position, a closing device is provided in order to close the opening in this first position, the refill container can be swiveled into a second position having a bottom opening with the aid of the receptacle device, and a discharge opening is provided in the closing device through which toner material can be taken from the refill container in the second position.

A toner refill container for conveying toner material in a printer or copier provides that an outer wall defines a cavity for receiving toner material, an opening for the discharge of toner material is arranged on top as viewed in vertical direction in a first position of the refill container, the section of the cavity towards the opening is reduced such that in a second position of the refill container in which the opening is arranged at the bottom, the outer wall of the refill container forms an angle of repose of at least 45°, as a result whereof the toner material present in the cavity slides towards the opening, and at least one support surface is arranged at the outer wall near the opening such that it rests on a support in the printer or copier in the second position and determines the position of the refill container in the printer or copier.

BRIEF DESCRIPTION OF THE DRAWINGS

For a better understanding of the present invention, reference is made in the following to the preferred embodiments illustrated in the drawings and described by using specific terminology. However, it is pointed out that the scope of the invention is not to be restricted thereby since such variations and further modifications on the device and/or the method illustrated as well as such further applications of the invention as shown are to be considered as common current or future expert knowledge of the person skilled in this art. Embodiments of the invention are shown in the Figures.

DETAILED DESCRIPTION OF THE PREFERRED EMBODIMENTS

Figure 1:
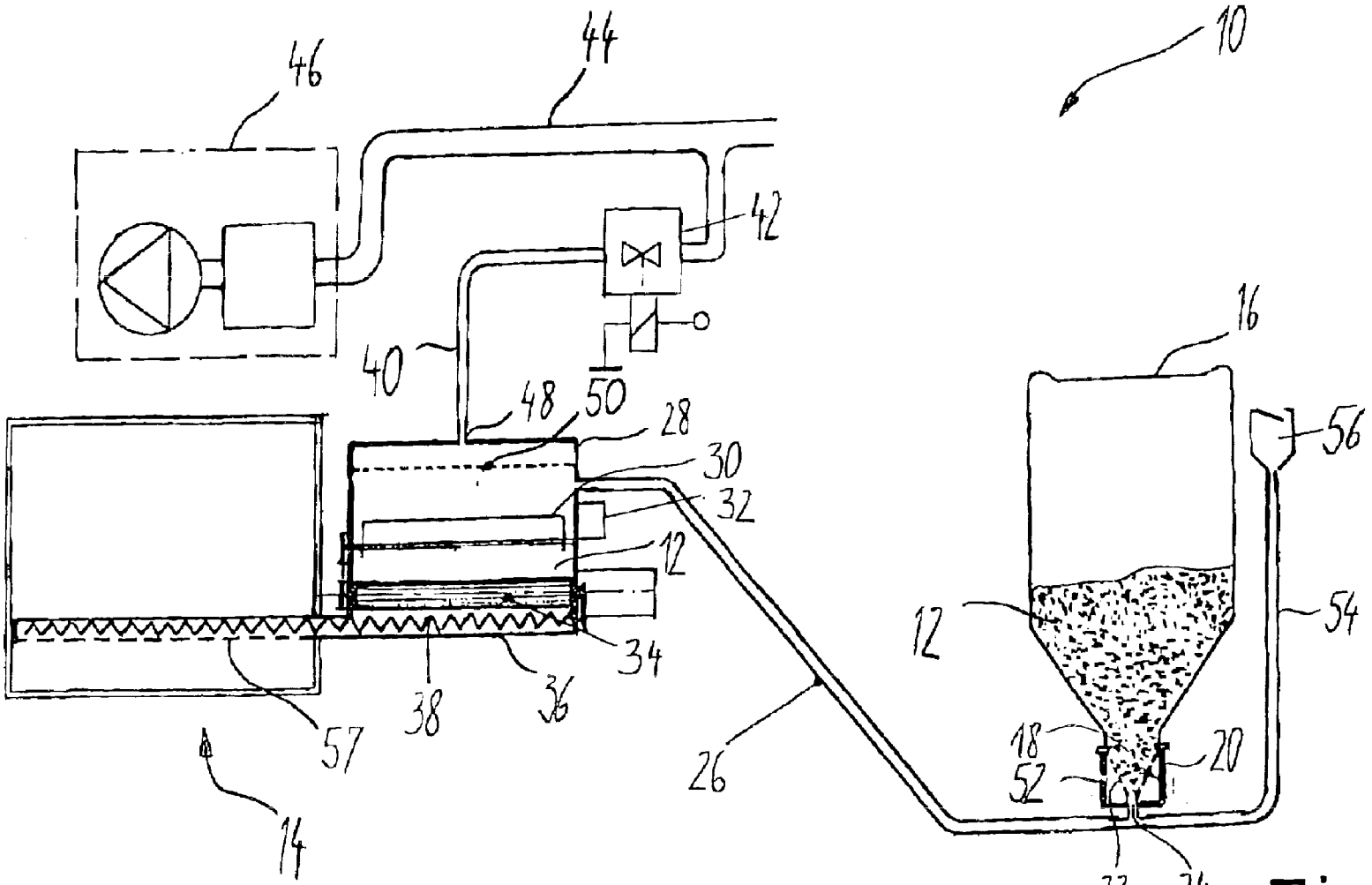
FIG. 1 is a schematic illustration of a structure of a toner conveying system in a printer or copier.

In a method of conveying toner material from a toner refill container, the refill container is arranged in a substantially upright position. In this first position, an opening for the discharge of toner material is closed by a closing device. With the aid of the receptacle device, the refill container is swiveled into a second position with bottom opening. Toner material is taken from the refill container through a discharge opening provided in the closing device. By means of this method, it is possible to insert the refill container into an electrographic printer or copier in a non-contaminating manner and to take toner material from the refill container in a substantially constant conveying stream. By means of the bottom discharge opening, the refill container can be completely emptied without any additional measures, such as a shaker means or suction tubes. By means of the inventive method also relatively large refill containers, for example with a volume of 5 to 20 kg of toner material, can easily be inserted into the printer or copier by an operator. The inventive method guarantees a complete emptying of the refill container and a non-contaminating handling during insertion and removal of the refill container.

In a development of the invention, the receptacle device includes a receptacle unit for receiving the refill container. The receptacle unit is swiveled out of the printer or copier for insertion and removal of the refill container. As a result thereof, an operator has enough space in order to be able to also insert large refill containers in an uncomplicated manner. In the course of this, it is advantageous to pull out the receptacle unit with the aid of a handle when it is swiveled out of the printer or copier. The movement of the receptacle unit is guided with the aid of a lever mechanism such that, after having been swiveled out, the discharge opening of the refill container is again positioned on top. The swiveling axis of the refill container runs approximately through its center of gravity. As a result thereof, the receptacle unit can easily be handled by the operator. Even in the case of a filled refill container, a great expenditure of force is not required when the receptacle unit is swiveled in or out.

In another embodiment of the invention, the closing device is connected to the refill container by a locking clamp. As a result thereof, a safe connection between the closing device and the refill container is guaranteed.

In another embodiment of the invention, the correct locking of the closing device is checked with the aid of a sensor before the refill container is swiveled into the second position. As a result thereof, it is possible to avoid contaminations caused by a closing device that is not correctly mounted.

In another advantageous embodiment, the refill container is pressed against the closing device with the aid of a spring when the refill container is in its first position. In this connection, it is advantageous when the closing device includes a sealing element, such as a sealing ring made of closed-cell foam. As a result thereof, it is achieved that the refill container is closed toner-tightly by means of the closing device so that no toner can escape. Contaminations caused by toner material can be avoided.

In a development of the invention, compressed air is admitted to the closing device when the refill container is in the first position so that toner material adhering to the closing device is removed and drops into the refill container. This assures that even during unlocking of the closing device no contamination with toner material occurs.

In another advantageous embodiment of the invention, the toner material is transported from the refill container to an intermediate reservoir arranged near a developer station of the printer or copier with the aid of suction air. In this case, it is advantageous when the closing device includes a suction head through which the toner material is conveyed out of the refill container. The suction head can include a fluid funnel having funnel walls through which air is flowing into the closing device and/or into a lower region of the refill container, as a result whereof a fluid-like toner material/air mixture is generated at least in the region of the funnel, said toner material/air mixture being conveyed away from the refill container with the aid of a hose. As a result thereof, clogging and compaction of the toner material in the closing device can be avoided. So-called toner cornices cannot form. The fluid-like toner material/air mixture can also be conveyed through relatively thin tube-like conduits, such as hoses, almost without any problems. The emptying of the refill container and the further transport of the toner material can thus be effected very easily. By transporting the toner material in tube-shaped conduits the toner material can be distributed particularly easily in the printer or copier, for example to several developer stations.

In this connection, reference is also made to the German patent applications 102 23 206.7 and 102 23 231.8 filed by the applicant simultaneously with the present application and which relate to a method of and a device for conveying toner material from a refill container as well as to a device and a method for dosing toner material in an electrographic printer or copier. These two patent applications are herewith incorporated by reference into the present application.

A further aspect of the invention relates to a device for conveying toner material from a toner refill container, the device avoiding contaminations with toner material when the toner material is fed into the printer or copier. When refilling the toner material into the printer or copier only simple operations are required and also relatively large refill containers having a volume for receiving toner material in the range between 5 kg and 20 kg can easily be handled by an operator. As a result thereof, it is also possible to continuously process large print jobs without interruption. The downtimes of a printing or copying system can be considerably reduced with this device.

Further, the invention relates to a toner refill container for feeding toner material into a printer or copier, by means of which refill container it is achieved that the toner material contained therein is completely conveyed therefrom without any further auxiliary means. The position of the refill container in the printer or copier is precisely defined by the support surface, as a result whereof the refill container is, for example, exactly sealed towards a closing device with the aid of a sealing disk. The escape of toner material between the refill container and the closing device is avoided. In particular in the case of large-volume refill containers having a toner receiving capacity in the range between 5 kg and 20 kg it is necessary that the sealing disk is not subjected to the entire weight of the refill container, since otherwise the sealing disk becomes damaged.

FIG. 1 illustrates a toner conveying system 10 of a printer or copier. The toner conveying system 10 serves for supplying toner material 12 into a developer station 14. The toner material 12 is supplied to the printer or copier (not illustrated) from a refill container 16 in which the toner material 12 is contained. An opening 18 serves for the discharge of the toner material 12. The opening is illustrated in a second bottom position, as explained further below. A closing device 20 is connected to the refill container 16 in a toner-tight manner such that toner material 12 slides from the refill container 16 into the closing device 20.

The closing device 20 includes a funnel 22 into which the toner material 12 slides from the refill container 16. The funnel 22 has a funnel outlet 24 that is connected to a tube system 26 in an air-tight and toner-tight manner. The tube system 26 connects the funnel outlet 24 with an intermediate toner reservoir 28 which is arranged near the developer station 14 and in which toner material 14 for further transport into the developer station 14 is intermediately stored. The reservoir 28 includes a U-shaped stirring arm 30, a level sensor 32 and a dosing apparatus 34 that comprises a bucket wheel. A toner conveying tube 36 having a toner conveying spiral 38 connects the reservoir 28 to the developer station 14 and conveys toner material 12 from the reservoir 28 to the developer station 14 according to need. The amount of toner material 12 conveyed into the developer station 14 is adjusted and dosed with the aid of the dosing apparatus 34 and/or the conveying tube 36 which are each connected to a drive means (not shown).

The U-shaped stirring arm 30 mixes the toner material 12 in the reservoir 28. The reservoir 28 is air-tight, the air-tightly closed space of the reservoir 28 being connected to a central vacuum line 44 via a tube system 40 including a control valve 42. A vacuum is generated in the central vacuum line 44 by means of a vacuum fan 46. The tube system 40 is connected to an upper portion of the reservoir 28. A filter 50 is arranged below the junction 48 towards the closed space. The reservoir 28 is connected to the tube system 26 below this filter 50. The control valve 42 controls the vacuum in the tube system 40 as well as in the reservoir 28 connected thereto and in the tube system 26. This vacuum provides that toner material 12 is transported from the funnel outlet 24 of the closing device 20 into the space of the reservoir 28 via the tube system 26.

The operation of the control valve 42 is effected in a two step operation, the conveyed amount of toner material 12 being dependent on the vacuum in the tube system 44 and the opening time of the control valve 42. However, in other embodiments, the amount of conveyed toner material 12 can also be adjusted continuously in many positions with the aid of the control valve 42.

The funnel 22 has porous air-permeable funnel walls. By means of the vacuum at the funnel outlet 24, air is sucked from the closing device 20 through the funnel walls into the funnel 22. As a result thereof, a toner/air mixture is generated in the funnel 22, said mixture having a fluid-like, so-called fluidized state. Air is supplied to the closing device 20 via an opening 52 in the closing device, said air being drawn into the funnel 20 with the aid of the vacuum as described. The air supplied through the opening 52 can be controlled via a valve (not illustrated). The funnel outlet 24 is further connected to a tube system 54 having a control valve 56, via which ambient air can be supplied to the tube system 26. Further, a check valve (not shown) is contained in the control valve 56, said check valve preventing the escape of toner material also in the case of unfavorable pressure conditions in the tube systems 44, 26, 54. The amount of toner material 12 that is conveyed from the refill container 16 into the reservoir 28 can be regulated via the control valve 56.

The control valves 42 and 56 are electrically driven valves. By means of the control valve 42 the vacuum conditions in the reservoir 28 and in the tube system 26 can be exactly adjusted. The toner transport from the refill container 16 to the reservoir 28 is controlled according to the signal of the level sensor 32. As already mentioned, the control valve 42 and the control valve 56 serve as actuators for the closed-loop control. The suction air required for the toner transport is adjusted by means of these control valves 42, 56. The toner material 12 exiting from the funnel outlet 24 is entrained by the air stream in the tube system 26, 54 and transported to the reservoir 28. The filter 50 in the reservoir 28 prevents the further transport of the toner material 12 into the tube system 40.

During the closing operation of the valve 42, the clean air side of the filter 50 is vented to ambient pressure. As a result thereof, there is, at least for a short time, a vacuum in the reservoir 28 compared to the ambient pressure in the tube system 40. During the subsequent pressure compensation between the tube system 40 and the reservoir, air flows from the tube system 40 through the filter 50 into the reservoir 28. The air stream during this pressure compensation has a direction opposite the direction of the air stream during intake of the toner material. Toner material 12 collected on the filter 50 is removed from the filter 50 by the air stream during the pressure compensation and drops into the reservoir 28. A possible escape of toner material 12 via the tube system 54 is prevented by means of the check valve 56. As already mentioned, the toner material 12 is transported from the reservoir 28 into the developer station 14 with the aid of a conveying tube 36. One end of the conveying tube 36 projects into the developer station 14 and has wide openings at an underside 57, through which openings the toner material 12 drops from the conveying tube 36 into the developer station 14.

The conveying spiral 38 contained in the conveying tube 36 has a pitch so that it transports toner material 12 in the conveying tube 36 from the reservoir 28 to the developer station 14 in a way similar to a screw conveyor. As already mentioned, the conveying spiral 38 is driven with the aid of a drive unit. The dosing apparatus 34 includes a drum that is similar to a bucket wheel and is arranged between the reservoir 28 and the conveying tube. Such a dosing apparatus 34 is also referred to as rotary discharger. The drum seals the reservoir 28 towards the conveying tube 36 almost air-tightly so that air is sucked out of the tube system 26 when a vacuum is generated with the aid of the vacuum fan 46. Preferably, the drum is driven synchronously with the conveying spiral 38, wherein in the case of a rotation of the drum, which is also referred to as a cell wheel, toner material drops from the reservoir 28 into the bucket compartments or, respectively, cells and is transported downwards to the conveying tube 36 by means of the rotation.

Below the dosing apparatus 34, the conveying tube 36 has a top opening towards the dosing apparatus 34 so that the toner material 12 drops from the cells downwards into the conveying tube 36. The U-shaped stirring arm 30 in the reservoir 28 is driven by means of a drive unit (not shown) and prevents formation of a cavity or respectively, cornice in the toner material 12 of the reservoir 28 by means of rotation.

Figure 2:
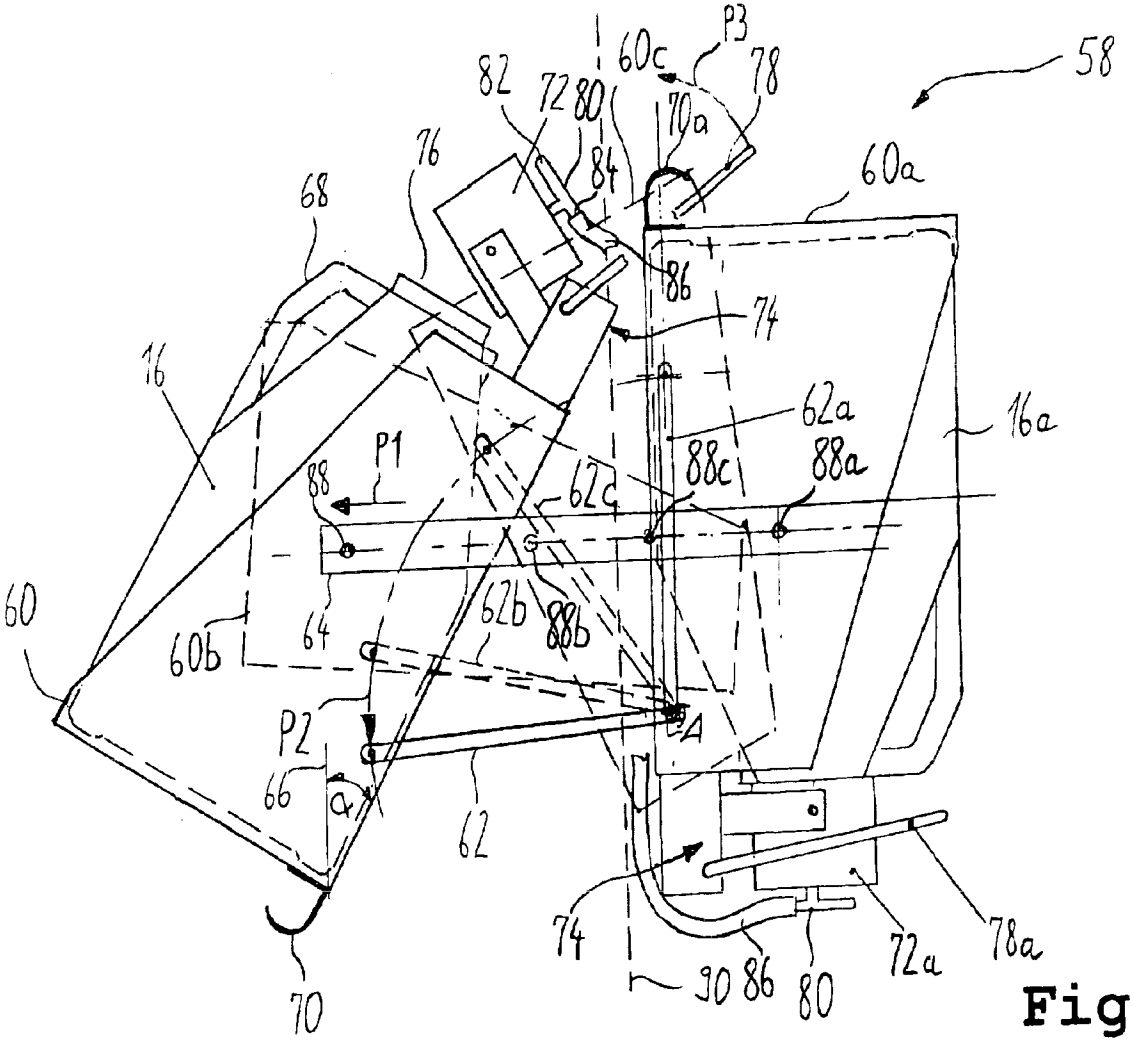
FIG. 2 is a side view which shows a receptacle device with a refill container, the inserting operation of the refill container into the printer or copier being illustrated with the aid of several superimposed positions of the receptacle device.

FIG. 2 illustrates a receptacle device 58 for receiving a refill container 16 filled with toner material 12. The same elements have the same reference signs. The receptacle device 58 includes a receptacle unit 60 which can be swiveled out of the printer or copier (not shown) via a first lever system comprising levers 62, 64. Different positions of individual elements while the receptacle unit 60 is swiveled in or, respectively out, are identified in FIG. 2 and the further Figures by reference signs differing from one another by added letters.

When the receptacle unit 60 is swiveled out of the printer or copier, the lever 64 is substantially pulled out of the printer or copier in the direction of the arrow P1.

The lever 62 is swiveled in the direction of the arrow P2 about the rotary axis A. The longitudinal axis of the receptacle unit 60 is inclined by the angle a with respect to a vertical axis 66 in the swiveled-out state. A stop (not illustrated) prevents that the receptacle unit 60 can be swiveled out further. The angle $\alpha$ has a value in the range between 10° and 30°. When the refill container 16 is carried by means of a carrying handle 68, the longitudinal axis of the refill container 16 is inclined in the same direction as the receptacle unit 60. As a result thereof, the refill container 16 can be easily inserted and removed from the receptacle unit 60 by an operator. The operator can swivel the receptacle unit 60 easily with the aid of a handle 70.

As already mentioned, the refill container 16 is inserted into the receptacle unit 60 by an operator with the aid of the carrying handle 68. Subsequently, an opening 76 provided in the top of the refill container is closed in a toner and air-tight manner by means of a closing device 72. The closing device 72 is connected to the receptacle unit 60 via a second lever system. With the aid of the second lever system 74, the closing device 72 is pressed onto the refill container 16 so that the closing device closes the opening 76. After closing the opening, the closing device 72 can be locked. The closing device 72 is designed similar to the closing device 20 according to FIG. 1.

For closing the opening 76, a lever 78 of the second lever system 74 is swiveled in the direction of the arrow P3. The closing device 72 includes a tube piece 80 for the discharge of toner material 12. The tube piece 80 is fashioned as a T-piece, a first end 82 containing a check valve, a second end being connected to the refill container 16 and a third end being connected to a hose 86 through which toner material 12 taken from the refill container 16 is transported to the developer station 14. The hose 86 forms part of the tube system 26 according to FIG. 1.

After closing the opening 76 with the aid of the closing device 72, the closed refill container 16 together with the receptacle unit 60 is swiveled into the printer or copier opposite the direction of the arrow P2. With the aid of a sensor (not shown), the correct position of the closing device 72 on the opening 76 of the refill container 16 is checked. With the aid of an electromechanical locking device (likewise not shown) the first lever system comprising the levers 62, 64 is blocked when the receptacle unit 60 is in the swiveled-out state as long as the opening 76 of the refill container 16 is not correctly closed by the closing device 72. Such a sensor can, for example, be coupled to the lever 78 and check its position.

With the aid of the handle 70, the operator swivels the receptacle unit 60 with the refill container 16 comprising the toner material 12 into the printer or copier, as already mentioned, the lever 62 first being swiveled opposite the direction of the arrow P2 into a position 62*b*, then into a position 62*c* and further until it reaches position 62*a*. Parallel thereto, the lever 64 is pushed back into the printer or copier opposite the direction of the arrow P1 until the receptacle unit 60 has reached the position 60*a*. The refill container 16 together with the receptacle unit 60 is swiveled about a rotary axis 88 running through the lever 64. When the receptacle unit 60 is swiveled into the printer or copier, the rotary axis 88 is displaced into the printer or copier together with the lever 64. The broken line 90 indicates the plane of the outer wall of the printer or copier in the swiveled-in state of the receptacle unit 60.

In the swiveled-in state, the opening 76 is turned downwards. The closing device 72 is mechanically locked so that the closing device 72*a* cannot be separated from the refill container 16*a* with the opening 76 being turned downwards. The toner material 12 in the refill container 16*a* slides through the opening 76 into the closing device 72*a*. As described in connection with FIG. 1, the toner material 12 is transported from the closing device 72*a* through the hose 86 to the reservoir 28.

Figure 3:
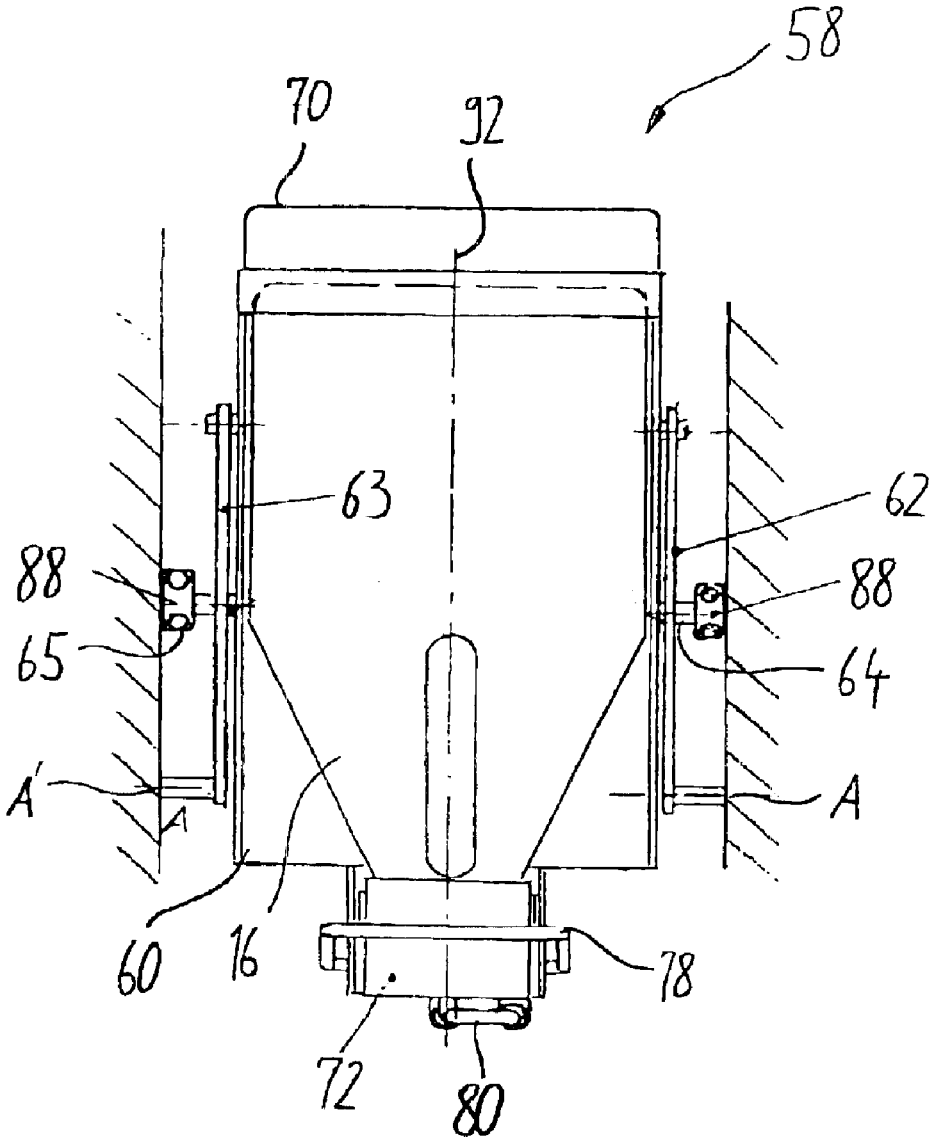
FIG. 3 is a side view which shows the refill container in the receptacle device in a second position for emptying the refill container.

In FIG. 3, the receptacle unit 58 is illustrated in a position in which it is swiveled into the printer or copier and in which the toner material 12 is taken from the refill container 16. The first lever system further includes a lever 63 and a lever 65 which substantially have the same structure as levers 62 or, respectively 64. The pair of levers comprising levers 63 and 65 is arranged about a central axis 92 of the receptacle unit 60 in a mirrored way to the levers 62 and 64. The central axis 92 of the receptacle unit 60 is at the same time the central axis of the refill container 16. In this swiveled-in position, the toner material 12 in the refill container 16 slides, as already described, into the closing device 72 from which the toner material 12 is further transported via the tube system 80 into the reservoir 28. The fulcrum A of the lever 62 is arranged on the same rotary axis as a fulcrum A' of the lever 63. The rotary axis 88 runs through the levers 64 and 65 (see FIG. 2).

The levers 64 and 65 are designed as telescopic rails that are rotatably connected to the sides of the receptacle device 60 at the point of intersection with the rotary axis 88. In the same way as the swiveling of the refill container 16 into the printer or copier has been described in connection with FIG. 2, the swiveling out takes place in opposite direction. When the receptacle unit 60 is swiveled in as well as swiveled out, the movement of the receptacle device 58 is guided by the levers 62, 63, 64, 65 in accordance with their rotary axes.

Figure 4:
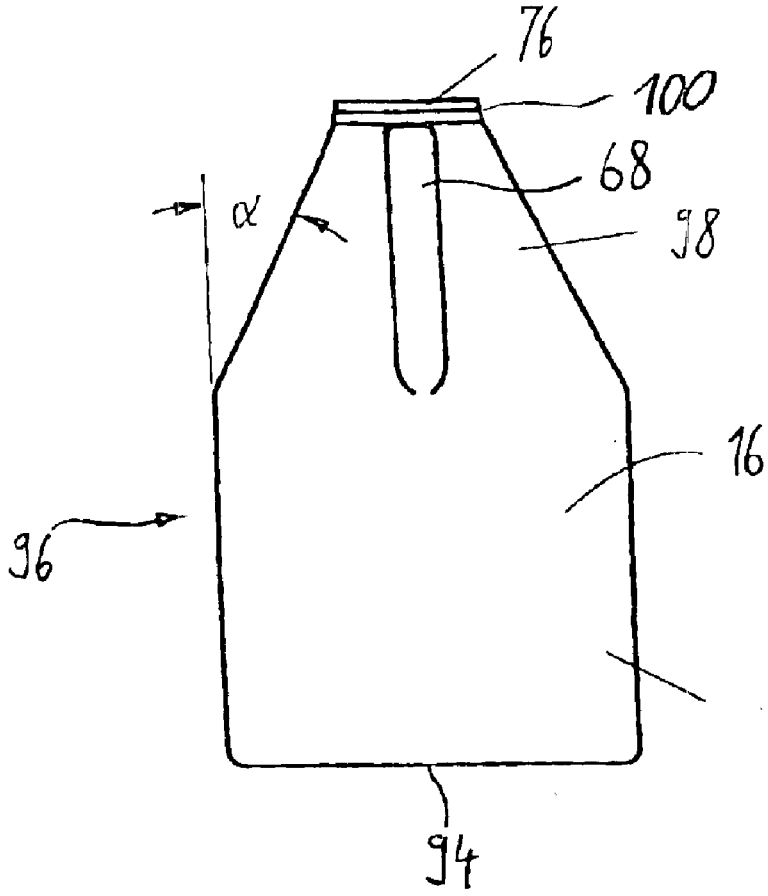
FIG. 4 is a side view of a refill container.

In FIG. 4 a side view of the refill container 16 is shown. The refill container 16 has a volume for receiving about 6 kg of toner material 12 and has a rectangular base surface 94, for example a square base surface. Starting out from this square base surface 94 substantially vertical side walls extend which form a cuboid area 96 that is followed by a funnel-shaped area 98 terminating in a bottleneck shaped area 100 having the opening 76. The area 100 has an external thread onto which a screw cap (not shown) can be screwed in order to close the opening 76 in a toner-tight manner during transport of toner material 12.

The funnel-shaped area 98 has an angle of repose between 45° and 70°. Due to this angle of repose, the toner material 12 simply slides out of the opening 76 when the opening is turned downwards. In FIG. 4, the complementary angle to the angle of repose has been referenced α and has a value between 45° and 70° depending on the angle of repose. Therefore, additional auxiliary means for emptying the refill container 16 are not necessarily required.

Figure 5:
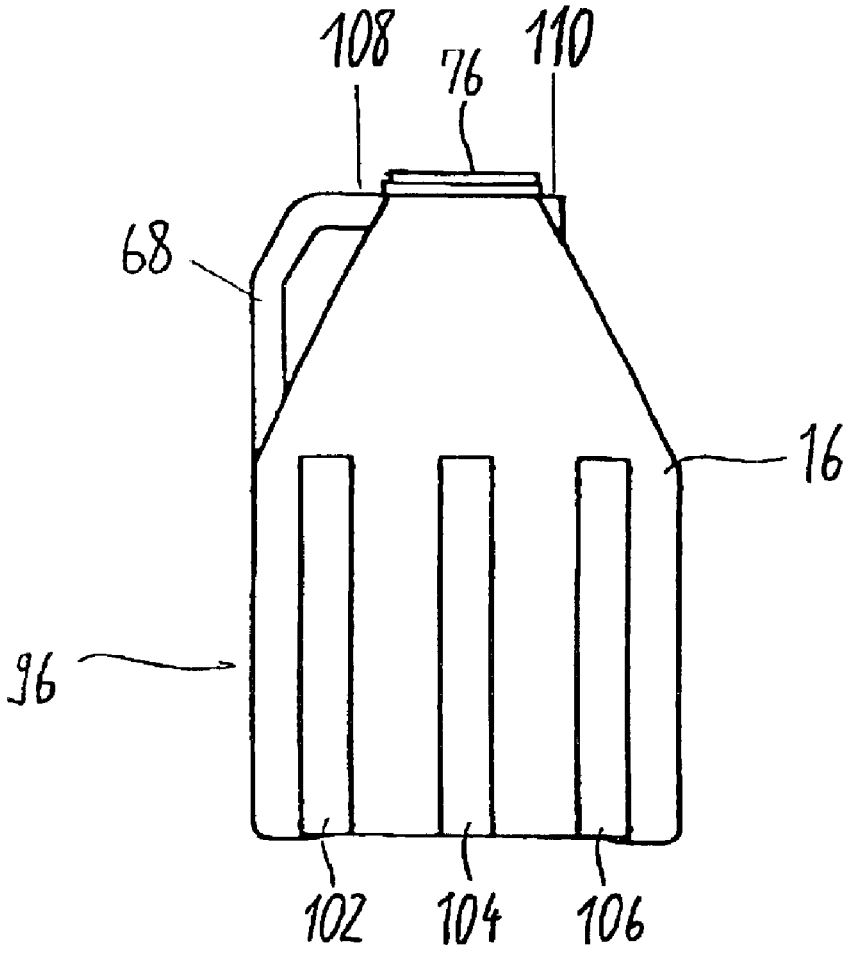
FIG. 5 is a side view of the refill container illustrated in FIG. 4 and rotated by 90°.

In FIG. 5 a side view of the refill container 16 according to FIG. 4 rotated by 90° is shown. In the cuboid-shaped area 96 of the refill container 16, stiffening elements 102, 104, 106 extend in order to achieve a high stability and rigidity of the refill container 16 in the case of low wall thicknesses. A support surface 108 as a carrying handle 68 near the opening 76 and a support surface 110 mounted on the outside of the refill container 16 serve to fix the position of the refill container 16 relative to the closing device 72, the refill container 16 seating with the support surfaces 108, 110, in particular in a position of the refill container 16 according to FIG. 3, on supports at the edge of the closing device 72.

Figure 6:
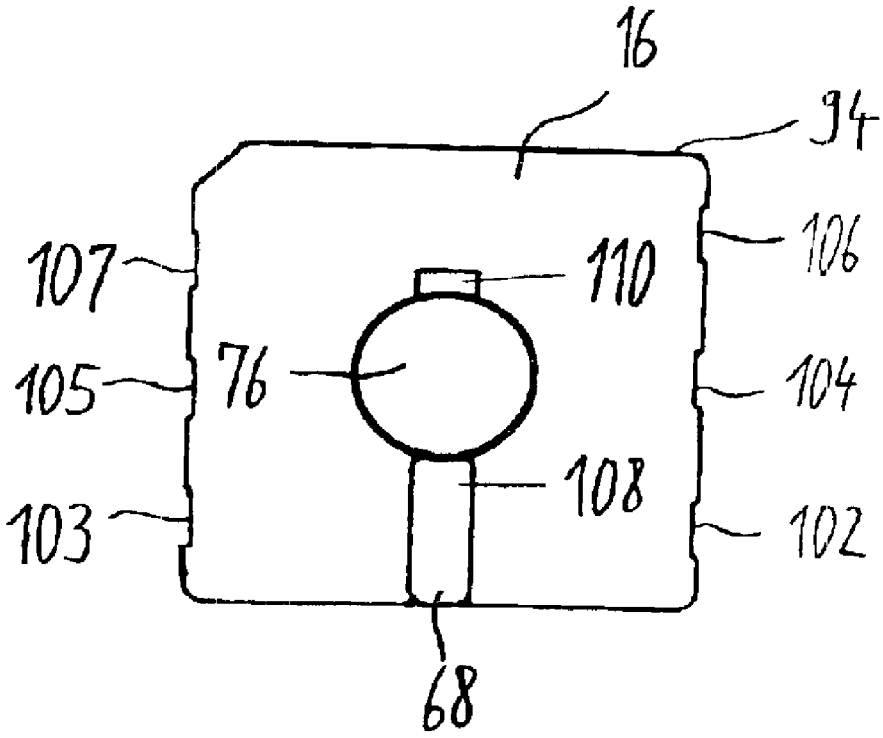
FIG. 6 is a top view of the refill container according to FIGS. 4 and 5.

In FIG. 6 a top view of the refill container 16 according to FIGS. 4 and 5 is illustrated. On the right and left hand side of the substantially square base surface 94, stiffening elements 102, 103, 104, 105, 106, 107 are arranged, the stiffening elements 103, 105, 107 substantially lying opposite the stiffening elements 102, 104, 106 shown in FIG. 5. The support surfaces 108, 110 are substantially arranged in a plane parallel to the base surface 94.

Figure 7:
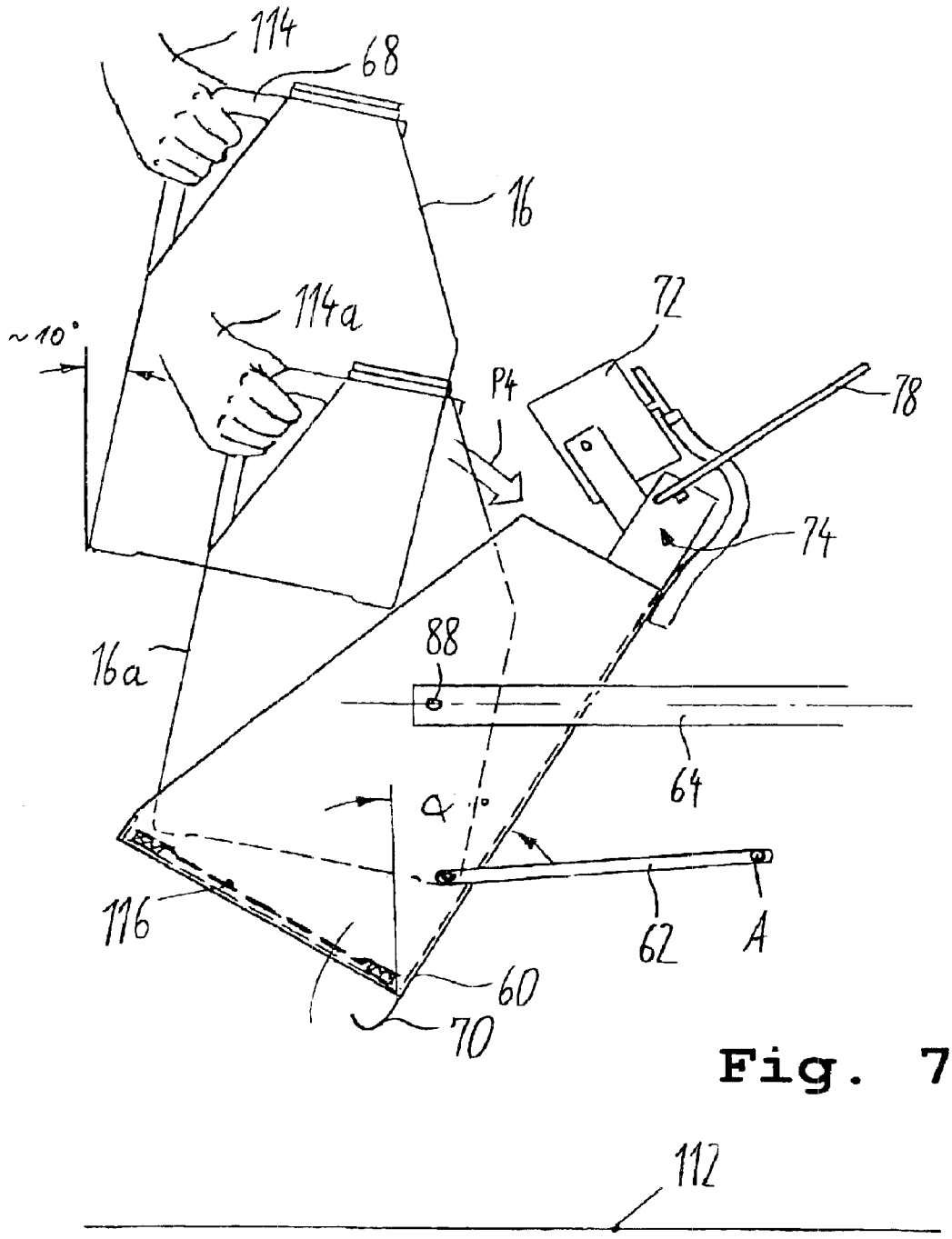
FIG. 7 is an elevational side view which shows the refill container and the receptacle device, the inserting operation of the refill container into the receptacle device being indicated.

In FIG. 7 the inserting operation of the refill container 16 into the receptacle unit 60 is illustrated. For clarification of the position of the elements, a substantially horizontally arranged reference plane is indicated by means of a horizontal line 112. This reference plane 112 can, for example, be a floor on which the printer or copier stands. The refill container 16 is inserted in the receptacle unit 60 by an operator (not shown), a hand 114 of the operator enclosing the carrying handle 68. The refill container 16 is inclined by about 10° from its vertical position and is inserted into the receptacle unit 60 in this position.

The operator guides the refill container 16 approximately to the position 16*a* and then releases the carrying handle 68, the refill container 16 tilting into the receptacle unit 60 in the direction of the arrow P4. A spring floor 116 is arranged at the bottom of the receptacle unit 60. When the refill container 16 is closed by means of the closing device 72, the refill container 16 is pressed against the closing device 72 with the aid of the spring floor 116 and as result thereof is sealed towards the closing device 72.

Figure 8:
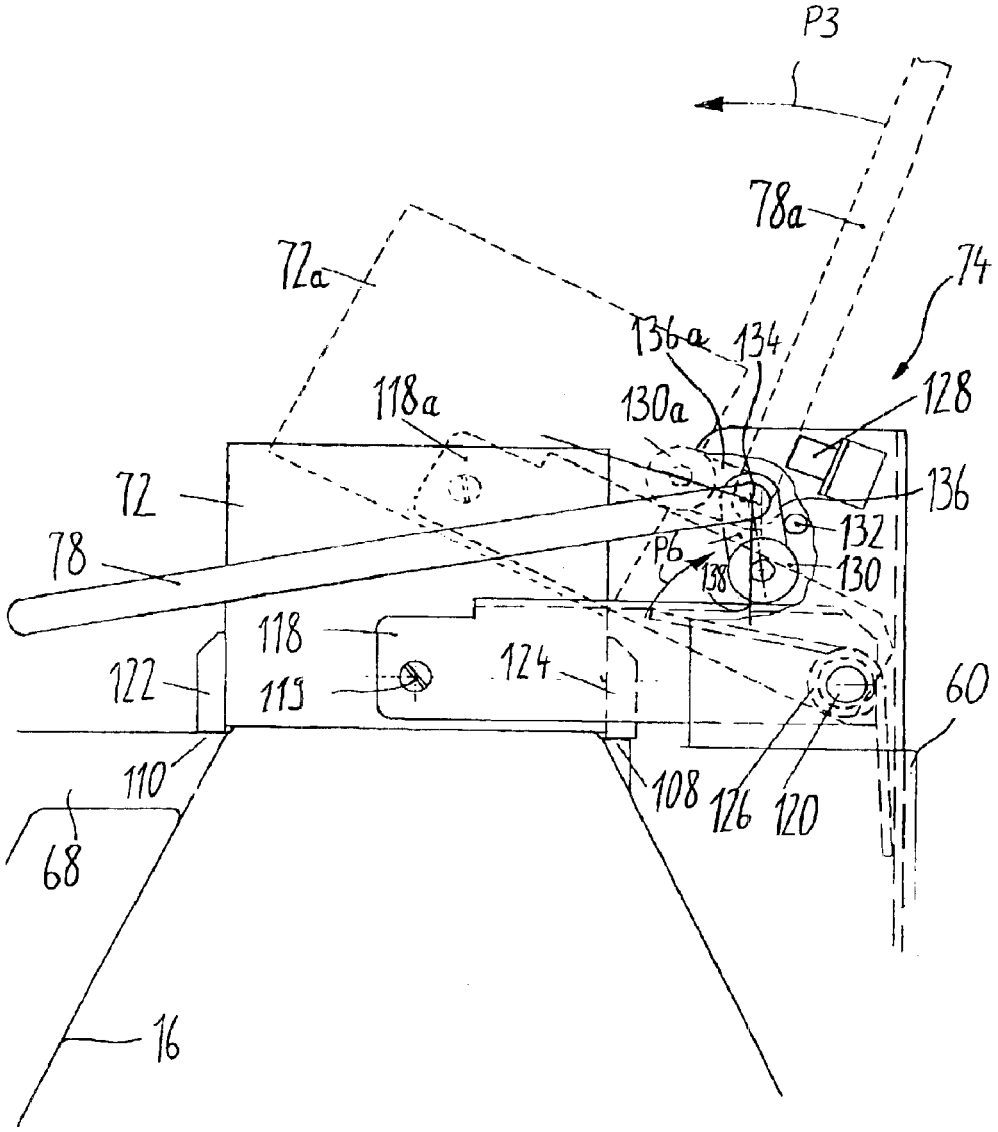
FIG. 8 is a side view which shows a swivel mechanism for swiveling a closing device towards the refill container.

FIG. 8 illustrates a detail of the closing device 72 together with the refill container 16. As already described in connection with FIG. 2, the closing device 72 is actuated with the aid of a lever system 74. Details of the lever system 74 are shown in FIG. 8. The closing device 72 and the lever system 74 are illustrated in solid lines in a position closing the refill container 16. With broken lines, the closing device 72 and the lever system 74 are shown in an open position 72*a*. The closing device 72 includes two supports 122, 124 on which the refill container 16 rests with the support surfaces 108, 110. In the closed condition of the closing device 72 the supports 122, 124 determine the position of the refill container 16 with respect to the closing device 72. The lever system 74 includes a U-shaped guiding arm 118, only one leg of the guiding arm 118 being illustrated. The closing device 72 is rotatably mounted in the guiding arm 118 on a rotary axis 119. Further, the guiding arm 118 has a rotary axis 120 at the receptacle unit 60. A rotary spring 126 is arranged about the rotary axis 120 such that it presses the guiding arm 118 in the direction of the arrow P6. The lever 78 is rigidly coupled to a further lever 136, a pressure roller 130 connected to the lever 136 pressing the guiding arm 118 together with the closing device 72 onto the refill container 16 for closing the refill container 16 when the lever 78 is moved in the direction of the arrow P3 or in a direction that is opposite to this direction of arrow.

When the refill container 16 is closed, the lever 136 bears against a stop 132, as a result whereof also the lever 78 can no longer be moved in the direction of the arrow P3 and remains in the position illustrated in solid lines. The position of the stop 132 is chosen such that the pressure roller 130 is guided over a point 138 that represents a lowest point. The pressure roller 130 is guided beyond the lowest point 138 up to the stop 132, as a result whereof the spring 126 presses the lever 136 against the stop 132 via the pressure roller 130. As a result thereof, an inadvertent release of the closing device 72 from the refill container 16 is prevented and the closing device 72 is mechanically locked.

For opening the closing device 72 the lever 78 is moved opposite the direction of arrow P3 by an operator. As a result thereof, the roller 130 is swiveled beyond the lowest point 138 up to the position 130*a*. The lever 78 can be swiveled up to the position 78*a* opposite the direction of arrow P3 for opening the closing device 72, in which position the lever 78 presses against a stop 128.

Figure 9:
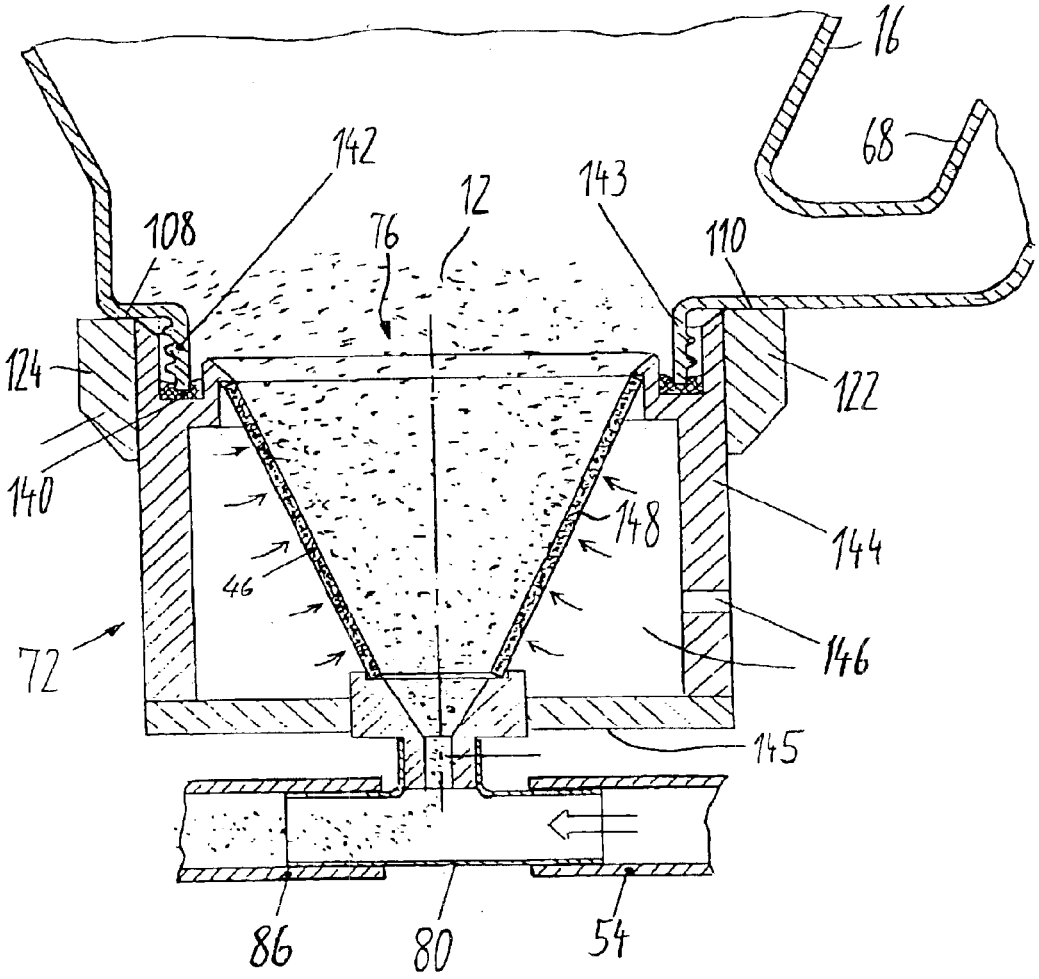
FIG. 9 is a sectional view of the closing device and a detail of the refill container in the second position.

In FIG. 9, a sectional view of the closing device 72 together with a detail of the refill container 16 is illustrated. The opening 76 of the refill container 16 is circular and is formed by side walls 142, 143. The front faces of the side walls 142, 143 are pressed into a circumferential sealing element 140. This sealing element 140 includes, for example, foam material or neoprene. Other sealing materials, such as rubber materials can likewise be used for the sealing element 140. The supports 124, 122 and the surfaces 108, 110 define the depth of impression with which the walls 142, 143 are pressed into the sealing element 140. This sealing element 140 is firmly connected to the closing device 72.

The closing device 72 has air-tight outer walls 144, 145 which seal the interior space of the closing device in an air-tight manner against the environment. However, ambient air can flow into the inside of the closing device via an air inlet opening 146. This amount of ambient air can, for example, be adjusted by means of a non-illustrated control valve or throttle valve. A funnel 148 is disposed inside the closing device, the funnel walls containing a toner-tight and air-permeable material. As already described, the toner material 12 slides from the refill container 16 by means of gravity through the opening 76 of the refill container 16 into the funnel 148. As already described in connection with FIG. 1, toner material 12 is sucked out of the closing device 72 via the tube-shaped element 80 through the tube system 26 or, respectively, through the hose 86 with the aid of a vacuum. In addition, the tube system 54 supplies air for conveying the toner material 12 in the hose 86.

The vacuum and the toner material 12 escaping from the funnel 148 effect that, as indicated by the arrows, air is sucked from the closing device 72 through the walls of the funnel 148 into the funnel 148. By means of this air, a fluid-type toner/air mixture is formed from the toner material 12 at least in the funnel 148. This toner material/air mixture flows into the tube 80 assisted by the suction operation. The fluid-type toner material/air mixture slides or, respectively, flows substantially better through the funnel 148 and the tube 80 than pure toner material 12. The toner material/air mixture is also better suited to be conveyed through the tube system 26 or, respectively, through the hose 86. By supplying air, no clogging or cornices are formed in the funnel 148. Up to the complete emptying of the refill container 16, the tube 80 can always be offered the same amount of toner material 12 so that a constant conveying stream of toner material 12 can be conveyed into the reservoir 28.

The supports 122, 124 effect that independent of the weight of the refill container 16 its side walls are pressed into the sealing element 140 up to a depth at a maximum, at which the surfaces 108, 110 rest on the supports 122, 124. In particular with refill containers 16 in the form of toner bottles or toner cans having a total weight of more than 5 kg, a destruction of the sealing disk 140 or a too high mechanical stress on this sealing disk 140 is avoided. By means of the supports 122, 124 and the support surfaces 108, 110, toner refill containers 16 having a weight of 20 or 30 kg can also be used without difficulties. In the position of the refill container 16 and the closing device 72 shown in FIG. 9, the refill container 16 is pressed against the supports 122, 124 by its own weight or, respectively by the weight of the container 16 and the toner material 12 stored therein. The sealing element 140 is only impressed up to a preset depth. In a position for the insertion of the refill container 16, as illustrated in FIG. 2 and already described in connection with FIG. 7, the refill container 16 is pressed against the sealing element 140 of the closing device 72 by the spring floor 116.

After the refill container 16 has been emptied, it is removed from the receptacle unit 60 and connected to a residual toner transport device. The residual toner transport device transports, for example, the toner material 12 that has been removed from the drums and belts and is no longer to be supplied to the electrophotographic process into the empty refill container 16.

When the closing device 72 is separated from the refill container 16, compressed air is admitted to the closing device 72. At this point in time, the refill container 16 is swiveled out so that toner material 12 adhering to the funnel 148 drops into the empty refill container 16. Contamination of the printer or copier by toner material 12 dropping out of the closing device 72 is thus avoided. The closing device 72 together with the funnel 148 is also referred to as a suction head.

In this connection reference is also made to the German patent applications 102 23 206.7 and 102 23 231.8 filed together with the present application on the same day and relating to a method of and a device for conveying toner material from a refill container as well as to a device for and a method of dosing toner material in an electrographic printer or copier. These two applications are herewith incorporated by way of reference into the present specification.

Although in the drawings and in the previous description preferred embodiments have been illustrated and described in every detail, this is to be considered as being merely exemplary and as not restricting the invention. It is pointed out that only the preferred embodiments have been illustrated and described and all variations and modifications which are within the scope of the invention at present or in the future are protected.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device;

taking toner material from said refill container via a discharge opening provided in the closing device;

providing a receptacle unit for said receptacle device for receiving the refill container;

swiveling said receptacle unit out from and into the printer or copier for inserting and respectively removing said refill container;

while said receptacle unit is swiveled out, pulling said receptacle unit out of the printer or copier using a handle; and guiding movement of said receptacle unit with a lever mechanism such that the opening of the refill container is swiveled from downwards to upwards.

2. A method according to claim 1, further comprising the step of:

pressing said refill container against said closing device by a spring while said refill container is in said first position.

3. A method according to claim 1, further comprising the step of:

transporting said toner material to the printer or copier in said refill container.

4. A method according to claim 1, further comprising the step of:

closing said refill container by a toner-tight closing device during the transport of the toner material.

5. A method according to claim 1, further comprising the steps of:

transporting said toner material from said refill container into a reservoir of a developer station of the printer or copier such that an almost constant amount of toner is present in the reservoir.

6. A method according to claim 1, further comprising the step of:

sealing said closing device against said refill container using a sealing element.

7. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device;

taking toner material from said refill container via a discharge opening provided in the closing device; and connecting said closing device to said refill container by a locking clamp.

8. A method of conveying toner material from a toner refill container in an eletrophotographic printer or copier, comprising the steps of:

arranging a refill container gaving an oppening for the discharge of toner in a receptacle device in substantially upright first position;

closing the opening in said first position by a closing device;

swiveling said refill container into a second position with a bottom opening provided in the closing device; and checking correct locking of said closing device using a sensor before said refill container is swiveled into said second position.

9. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device;

taking toner material from said refill container via a discharge opening provided in the closing device; and inserting said refill container into said receptacle device using a carrying handle laterally mounted on the refill container.

10. A method according to claim 9, further comprising the steps of:

inclining said refill container during transport using said carrying handle according to its center of gravity; and arranging a receptacle unit of the receptacle device during insertion of the refill container such that said refill container is inserted into the receptacle unit in an inclined position.

11. A method according to claim 10, wherein said step of inclining inclines a longitudinal axis of refill container by approximately 10° with respect to a vertical axis.

12. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device;

taking toner material from said refill container via a discharge opening provided in the closing device;

removing said refill container from said receptacle device after having been emptied;

connecting said empty refill container to a residual toner transport device; and conveying residual toner material into the refill container.

13. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device;

taking toner material from said refill container via a discharge opening provided in the closing device;

swiveling said refill container into the first position for removal; and providing compressed air to said closing device before said closing device is separated from said refill container so that toner material adhering to said closing device is removed and drops into the refill container.

14. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device; and taking toner material from said refill container via a discharge opening provided in the closing device, wherein said toner material is transported from said refill container to the reservoir using suction air.

15. A method of conveying toner material from a toner refill container in an electrophotographic printer or copier, comprising the steps of:

arranging a refill container having an opening for the discharge of toner material in a receptacle device in a substantially upright first position;

closing the opening in said first position by a closing device;

swiveling said refill container into a second position with a bottom opening with an aid of said receptacle device;

taking toner material from said refill container via a discharge opening provided in the closing device; and providing a suction head for said closing device through which said toner material is conveyed out of said refill container.

16. A method according to claim 15, further comprising the step of:

supplying air to said toner material via air-permeable funnel walls of a funnel contained in the suction head to generate a flowable toner material/air mixture.

* * * * *